US008887910B2

(12) United States Patent
Ashley et al.

(10) Patent No.: US 8,887,910 B2
(45) Date of Patent: Nov. 18, 2014

(54) LOW PROFILE PROTECTIVE COVER CONFIGURABLE AS A STAND

(71) Applicant: M-Edge Accessories, LLC, Odenton, MD (US)

(72) Inventors: Adam Ashley, Odenton, MD (US); Patrick Mish, Odenton, MD (US); James Ward, Ashburn, VA (US)

(73) Assignee: M-Edge International Corp., Hanover, MD (US)

( * ) Notice: Subject to any disclaimer, the term of this patent is extended or adjusted under 35 U.S.C. 154(b) by 0 days.

(21) Appl. No.: 13/759,494

(22) Filed: Feb. 5, 2013

(65) Prior Publication Data

US 2014/0216971 A1 Aug. 7, 2014

(51) Int. Cl.
*B65D 85/00* (2006.01)
*A45C 11/24* (2006.01)

(52) U.S. Cl.
CPC ..... *A45C 11/24* (2013.01)
USPC ..... 206/320; 206/45.2; 206/45.24; 206/45.23

(58) Field of Classification Search
USPC ..... 206/320, 305, 701, 216, 45.2, 45.23, 206/45.24, 449, 453, 454, 455, 586
See application file for complete search history.

(56) References Cited

U.S. PATENT DOCUMENTS

| | | | | |
|---|---|---|---|---|
| 5,887,723 | A * | 3/1999 | Myles et al. | 206/760 |
| 7,735,644 | B2 * | 6/2010 | Sirichai et al. | 206/320 |
| D689,501 | S * | 9/2013 | Fong | D14/447 |
| 2010/0294683 | A1 * | 11/2010 | Mish et al. | 206/320 |
| 2012/0037523 | A1 * | 2/2012 | Diebel et al. | 206/320 |
| 2012/0091312 | A1 * | 4/2012 | Baker | 248/682 |
| 2012/0097831 | A1 * | 4/2012 | Olukotun et al. | 248/688 |
| 2012/0234716 | A1 * | 9/2012 | Chen | 206/472 |
| 2013/0134061 | A1 * | 5/2013 | Wu et al. | 206/320 |

* cited by examiner

*Primary Examiner* — Anthony Stashick
*Assistant Examiner* — James Way
(74) *Attorney, Agent, or Firm* — Drinker Biddle & Reath LLP

(57) ABSTRACT

A protective cover having a front cover, a rear cover including a middle rear cover, an exterior rear cover, and a folding portion that connects the middle rear cover to the exterior rear cover, an articulable back that connects the rear cover to the front cover, a holding sheet that is attached to an inner surface of the exterior rear cover and is not attached to the middle rear cover, the holding sheet having bands located at corners of the holding sheet, the bands configured to be attached to corners of an electronic device for securing the electronic device to the protective cover, and an anti-slip pad attached to an inner surface of the front cover.

16 Claims, 10 Drawing Sheets

LOW PROFILE PROTECTIVE COVER CONFIGURABLE AS A STAND

FIELD OF THE INVENTION

The present invention relates generally to a protective casing or cover for an electronic device having a display, the protective casing or cover having a very low profile that can be unfolded to be configured as a stand for the electronic device.

BACKGROUND OF THE INVENTION

Various types of electronic devices are currently available for a variety of different purposes, such as communications, business, entertainment, having a tablet bar shape with a display screen covering a large part of the front face of the electronic device, and are not the traditional foldable devices like the conventional laptop or notebook design. Because these electronic devices are mobile and are often carried around by the user, protective covers have been designed to protect the electronic device from scratches, impacts, dust, water, but also for aesthetic purposes for example made of leather. However, conventional protective covers usually require multiple parts that protrude from a back cover sheet of the protective cover, making the protective cover design thick and bulky. Also, usually protective covers use plastic clips or holders to attach an electronic device, and these clips or holders can break after some time of usage, so that the protective cover needs to be replaced. In addition, many conventional protective covers use many additional components to use the protective cover as a stand, for example a leg that is attached on an outer surface of casing so that the protective cover can serve to hold the display screen at a certain angle towards the user. Accordingly, despite the existing solutions for protective covers, there is still a need for improved and simplified designs of protective covers.

SUMMARY OF THE EMBODIMENTS OF THE INVENTION

According to one aspect of the present invention, a protective cover is provided. The protective cover includes a front cover, a rear cover including a middle rear cover, an exterior rear cover, and a folding portion that connects the middle rear cover to the exterior rear cover. The protective cover further includes an articulable back that connects the rear cover to the front cover, a holding sheet that is attached to an inner surface of the exterior rear cover and is not attached to the middle rear cover, the holding sheet having bands located at corners of the holding sheet, the bands configured to be attached to corners of an electronic device for securing the electronic device to the protective cover; and an anti-slip pad attached to an inner surface of the front cover.

According to another aspect of the present invention, an electronic device casing is provided. The casing includes a front cover sheet and a rear cover sheet including a middle section, an exterior section, and a hinge portion that connects the middle section to the exterior section of the rear cover sheet, the front cover and the rear cover having inner surfaces that face each other when the casing is in a closed state. The casing includes a spine portion that connects the rear cover sheet to the front cover sheet, an elastic flat holding mat that is attached to an inner surface of the exterior section of the rear cover sheet, the holding mat having openings located at corners of the holding mat, the openings configured to be pulled over corners of the electronic device so that the opening engage with corners of the electronic device for securing the electronic device to the casing. The casing also includes an anti-slip pad attached to an inner surface of the front cover.

The summary of the invention is neither intended nor should it be construed as being representative of the full extent and the scope of the invention, which additional aspects will become more readily apparent from the detailed description, particularly when taken together with the appended drawings.

BRIEF DESCRIPTION OF THE SEVERAL VIEWS OF THE DRAWINGS

The accompanying drawings, which are incorporated herein and constitute part of this specification, illustrate the presently preferred embodiments of the invention, and together with the general description given above and the detailed description given below, serve to explain features of the invention.

Herein, identical reference numerals are used, where possible, to designate identical elements that are common to the figures. Also, the images in the drawings are simplified for illustration purposes and may not be depicted to scale.

DETAILED DESCRIPTION OF THE SEVERAL EMBODIMENTS

Figure 1:
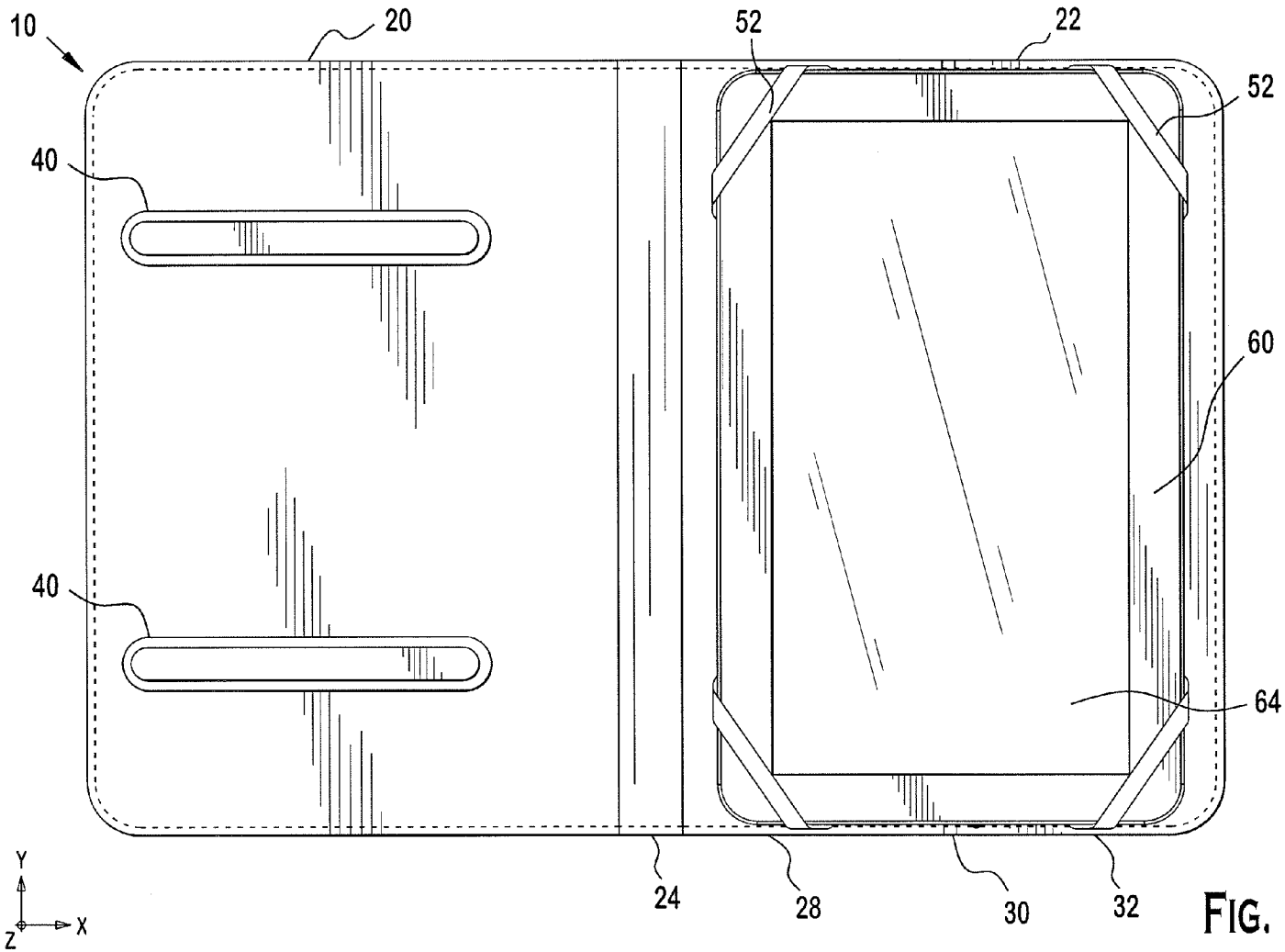
FIG. 1 shows a plan view of a protective cover in an open state including an electronic device.
Figure 2:
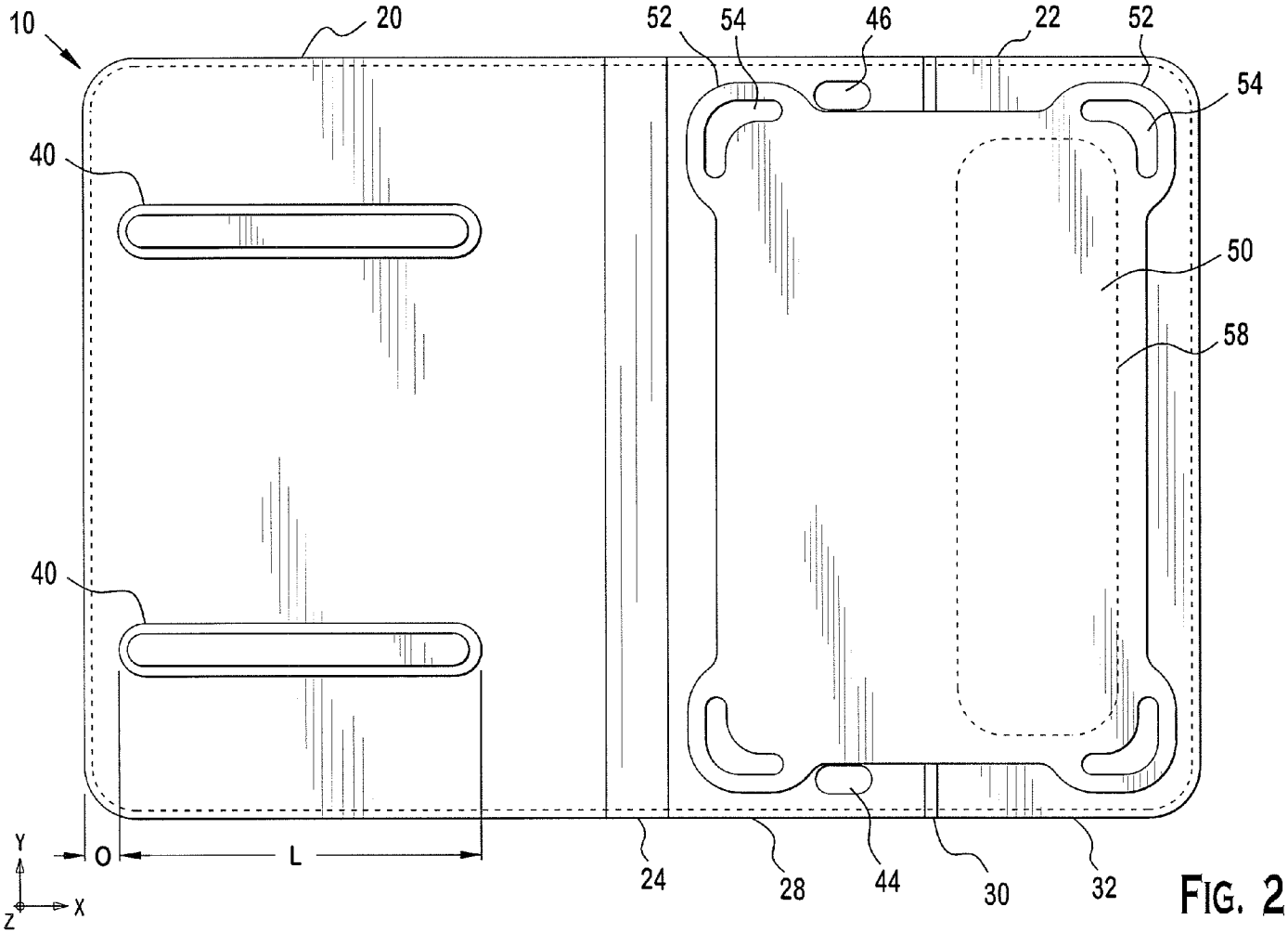
FIG. 2 shows a plan view of a protective cover in an open state with the electronic device removed.
Figure 3:
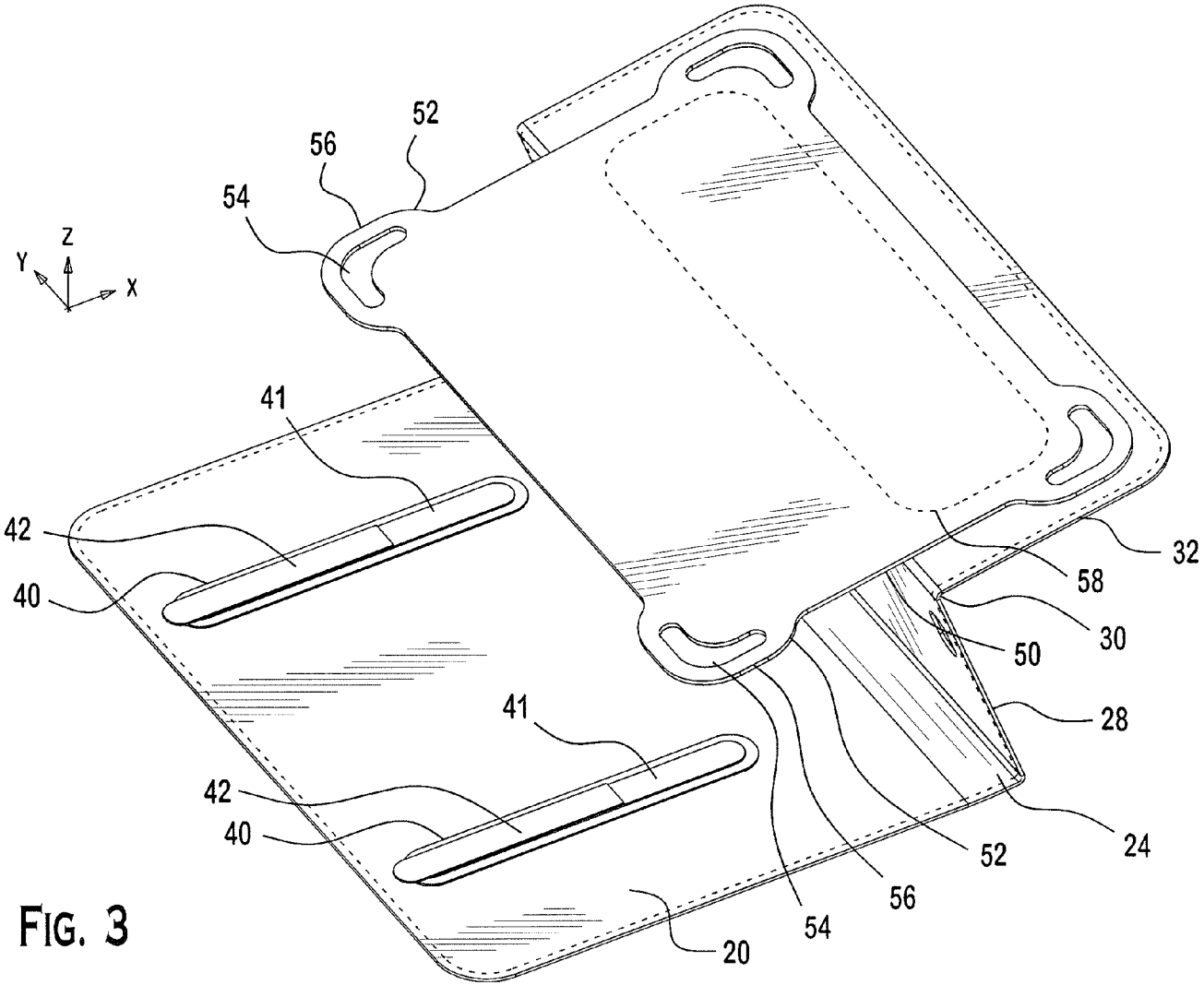
FIG. 3 shows a perspective view of the protective cover having angled rear cover sheet.

FIG. 1 shows a plan view of the protective cover 10 according to an embodiment of the present invention holding a computerized mobile electronic device 60 having a tablet shape, such as audio players, video players, portable digital video disk (DVD) players, cellular phones, smartphones, navigation devices, personal digital assistants, display units, e-book readers like Amazon Kindle™, tablet computers like Apple Ipad™, or Android-based tablets like Samsung GalaxyTab™, whereas FIG. 2 shows the same plan view of the protective cover 10 without the electronic device 60. For descriptive purposes, the description below makes references to an x, y, and z Cartesian coordinate system that is depicted in FIGS. 1, 2, and 3, in which the y-direction is defined by the longitudinal extension of cover 10, the x-direction is defined by the width extension of cover 10, and the z-direction is defined as being a direction that is perpendicular to the planar extension of cover 10 in an open position. In this respect, the negative x-direction is referred to as the left side, while the positive x-direction is referred to as the right side.

The protective cover 10 is made of a front cover sheet 20 that is attached via an articulable, pivotable, or foldable back portion 24, or spine portion, to a rear cover sheet 22. The articulable back portion 24 is arranged such that the front cover sheet 20 and rear cover sheet 22 can be folded relative to each other to close the protective cover 10 to contain electronic device 60. In a closed state, the inner surfaces of front cover sheet 20 and rear cover sheet 22 face each other and can sandwich an electronic device 60 between each other, the front cover sheet 20 and the rear cover sheet 22 arranged substantially parallel to each other. In an open state, the display 64 of electronic device 60 is exposed, and front cover sheet 20 can be opened at various angles towards rear cover sheet 22. At least one of the front cover sheet 20 and the rear cover sheet 22 can also be equipped with a mechanism (not shown) to hold front and rear cover sheet 20, 22 together in a closed state, for example but not limited to an elastic band, a Velcro strap, a zipper, magnetic strap, buckle, clip-on band, push-button band laces. In addition, the rear cover sheet 22 is also configured to be foldable separately from the folding of sheets 20, 22 relative to each other, and for this purpose rear cover sheet 22 is composed of a middle sheet 28 and an exterior sheet 32 that are connected to each other via folding member 30 (e.g., a hinge). In the embodiment shown, folding member 30 splits rear cover sheet 22 into two, substantially equal-sized parts, the middle sheet 28 and exterior sheet 32. A holding sheet 50 that is configured to attach to electronic device 60 is attached to the exterior sheet 32 of rear cover sheet 22 by an attachment thread 58, but is not attached to middle sheet 28 of rear cover sheet 22. Holding sheet 50 is configured such that it serves as a mounting bracket to hold electronic device 60 removably to protective cover 10, as further discussed below.

As shown in FIG. 3, folding member 30 is arranged in a way that rear cover sheet 22 can be bent such that the left side of holding sheet 50, the part of holding sheet 50 that is not attached to inner surface of middle sheet 28, can space from inner surface of middle sheet 28 of rear cover sheet 22, as shown in FIG. 3, and can be bent back to the initial position again so that holding sheet 50 and rear cover sheet 22 lie parallel on top of each other. Also, folding member 30, middle sheet 28 and exterior sheet 32 can be configured such that they do not bend to the other direction, the direction in which middle sheet 28 of rear cover sheet 22 would push against holding sheet 50. This arrangement could help to avoid that electronic device 60 would be pushed out from holding member 50. Moreover, holding sheet 50 is attached to the exterior sheet 32 of rear cover sheet 22 with a thread 58. In the embodiment shown, thread 58 leads at a certain distance from outer edge of the part of holding sheet that is located over the exterior sheet 32, and is thereby securely attached to exterior sheet. In a variant, holding sheet 50 can be attached to exterior sheet 32 in many different ways, for example, but not limited to adhesive glue, staples, rivets, plastic welding.

Figure 4:
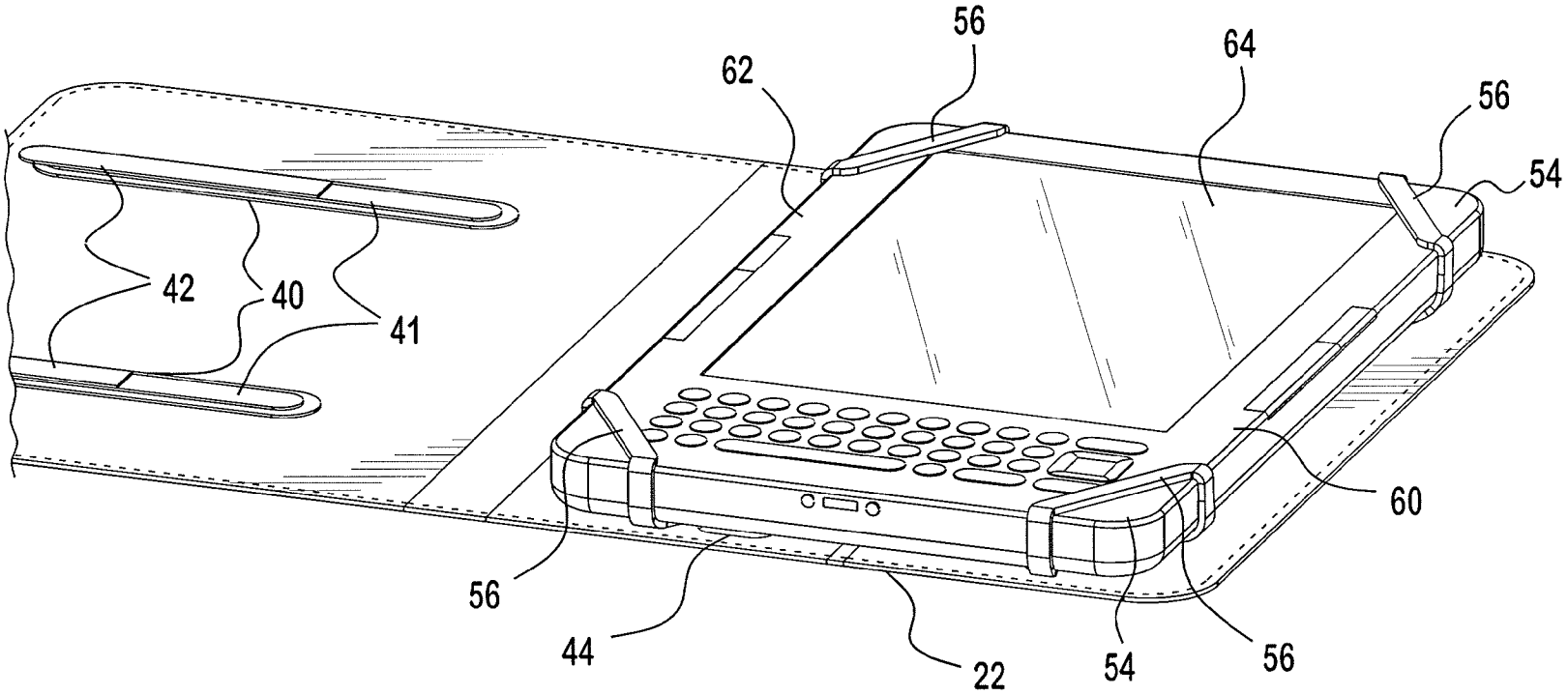
FIG. 4 shows a perspective view of the protective cover with the electronic device attached thereto in an opened state.

In the variant shown, holding sheet 50 is made of one piece of flexible and elastic rubber-like material having a thickness that is preferably in a range of 0.75 mm to 3 mm, for example but not limited to silicone, rubber, urethane, fluoroelastomer, fluorosilicone, ethylene propylene (EPR), that lies planar on the rear cover sheet 22 without any upward protrusions when no electronic device 60 is attached to holding sheet 50. For example, holding sheet 50 can be made of a rubber mat having an upper surface in the z-direction that has anti-slip properties against a back face of an electronic device 60 that is attached to holding sheet 50. For attachment to electronic device 60, holding sheet 50 has openings 54 in all four corners, and with each corner a holding band or strip 52 is formed that is arranged to bulge away from the corners, so that an outer edge of holding band 52 lies beyond side edges of a middle section of the holding sheet 50. Due to the elasticity of holding bands 52, when an electronic device 60 is placed centered onto holding sheet 50, the bands 52 can be pulled over the corners of electronic device 60 to fasten electronic device 60 to holding sheet 50, as shown in FIG. 4. Thereby, lower side 56 of holding bands 52 as referenced to a relaxed position when device 60 is not present, and can be turned upside-down and faces away from the upper surface of the corner of electronic device 60. Holding bands 52 are designed such that they do not reach into a screen 64 of electronic device 60, so that viewing and touch-screen operation is not obstructed. Holding sheet 50 with the holding bands 52 can be made of a single sheet and by cutting out four openings 54 in the corners, and by also cutting away side sections of holding sheet 50 between the holding bands 52. When holding bands 52 are attached to device 60, a left side wall 62 of electronic device 60 is not covered by holding sheet 50.

Once electronic device 60 is released from holding sheet 50 by manually pulling holding strips 52 over the corners of electronic device 60, holding sheet 50 goes back to the planar shape that lies on top of upper surface of rear cover sheet 22. This arrangement and design of the holding sheet 50 allows keeping the thickness T of cover 10 in a z-direction smaller than conventional covers that have holding clips made of hard plastic, or stiff leather, or similar arrangements that protrude in the z-direction away from rear cover sheet 22. This also allows to provide a protective cover 10 having a very low profile when electronic device 60 is removed. Also, the simple, one-piece designs of the holding sheet 50 allows to reduce the number of components used to make a holding bracket for an electronic device, thereby reducing complexity of the design that usually rely on multiple attachment bands and holding clips, and lowering its cost. In addition, the design only needs one attachment thread 58 or adhesive material to attach sheet 50 to rear cover sheet 22, so that the design is reliable and durable. Also, compared to conventional protective covers, the holding sheet 50 can be easily replaced if it tears. In a variant, it is also possible that holding sheet 50 is removably attached to exterior sheet 32, for example but not limited to a Velcro, for easy replacement.

Figure 5:
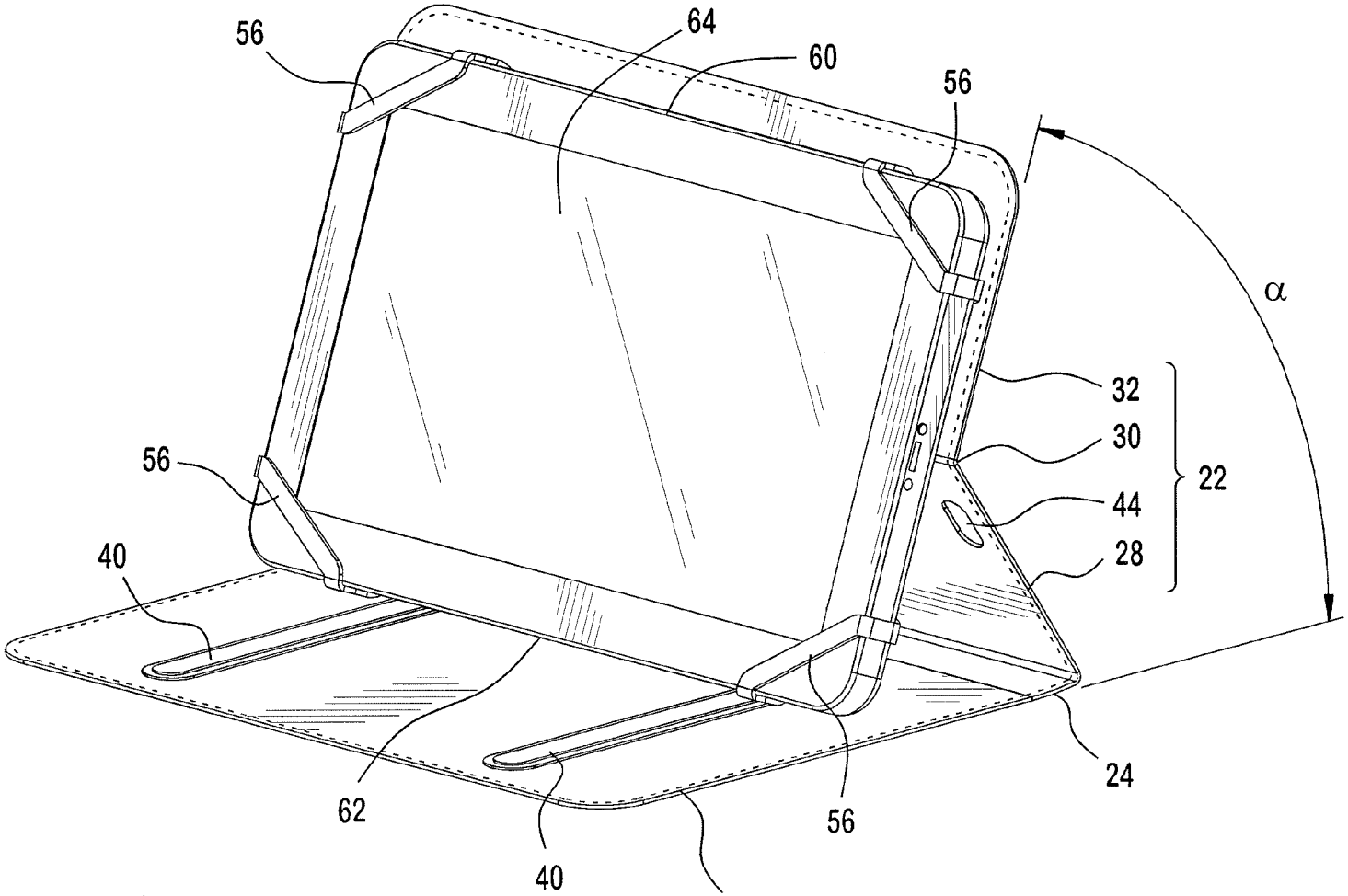
FIG. 5 shows a perspective view of the protective cover in a first open position with the electronic device attached thereto.
Figure 6:
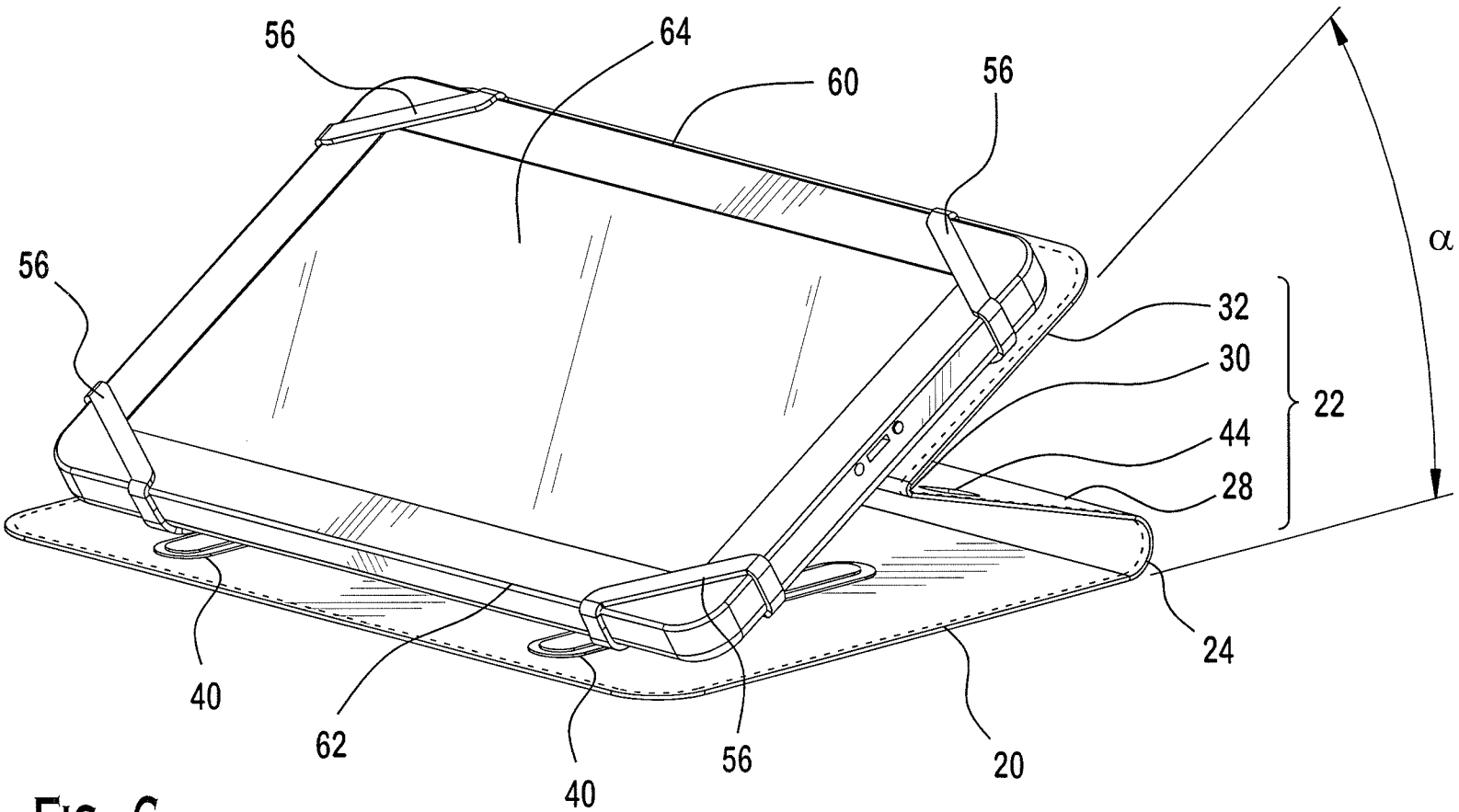
FIG. 6 shows a perspective view of the protective cover in a second open position with the electronic device attached thereto.

Also, the inner side of front cover sheet 20 has one or more holding tabs or pads 40 that are arranged perpendicularly to a longitudinal extension of the articulable back portion 24, offset from the left side edge of front cover sheet by a distance O, and having a length L. Holding tabs 40 are configured to hold the electronic device 60 in an upright position when electronic device 60 is attached to holding sheet 50, so that a user can put the protective casing 10 on a desk or other surface for reading, the protective casing 10 serving as a stand allowing multiple stand angles, as shown in FIGS. 5-6. In the embodiment shown in FIGS. 1-6, there are two holding tabs 40 that extend over 70% of the inner side of front cover sheet 20 having a length L of about 90 mm, and offset from the left side edge by about O=13 mm. Holding tabs 40 are attached to the inner side of front cover sheet 20 by an adhesive, thread or other suitable attachment means, and have an upper surface 41 with anti-slip properties, for example holding tabs 40 are made of a rubber-like material that has an upper surface 41 with microscopic pores that act as suction cups on side edge 62 of electronic device 60, or has another type of surface having a coefficient of friction that is sufficient to prevent electronic device 60 from slipping when the side edge 62 of electronic device 60 is placed onto holding tabs 40. Alternatively, upper surface 41 can be made of a roughened surface, for example dented, embossed, sand-paper like, or by another type of surface that improves friction resistance to side edge 62 of electronic device in a direction along the longitudinal axis of the holding tabs 40. In addition, in a variant, tabs 40 do not have a longitudinal shape, but the entire inner surface or a part of the inner surface is formed to have anti-slip properties to hold electronic device 60 at a desired position, for example by using an embossed rubber surface on the inner side of front cover sheet 20.

With electronic device 60 attached to holding sheet 50, the left side edge 62 of electronic device 60 can be put onto the upper surface 41 of holding tabs 40, by opening protective cover 10 by unfolding front and back cover sheets 20, 22 via articulable back portion 24, and by bending folding member 30 so that side edge 62 of electronic device moves away from articulable back portion 24, and can be posed onto tabs 40. Protective cover 10 can then be placed onto the front surface of front cover sheet 20 on a flat surface like a table, sofa, desk, so that a user can view screen 64 of electronic device 60 at a stand angle cc, for example an angle $\alpha$ of about 75°, as shown in FIG. 5. Upper surface 41 of tabs 40 have anti-slip properties that are configured such that electronic device 60 rests in its upright angled stand position when side edge 62 is positioned onto tabs 40. FIG. 6 shows electronic device 60 attached to holding sheet 50 in which side edge 62 is located close to the outer edges of tabs 40, having a stand angle $\alpha$ of about 30°. Tabs 40 are designed both in length and position as well as with upper surface 41 having a coefficient of friction such that a wide range of stand angles for electronic device 60 is possible, ranging from approximately 30° to 80°, without the need to attach side edge 62 or other parts of electronic device 60 or rear side cover 22 with other means. Also, in a case where tabs 40 are made of a very sticky material, they can be covered with a protective sheet or cover (42) to avoid accumulation of dust when side edge 62 of device 60 is not posed on tabs 40.

Figure 7:
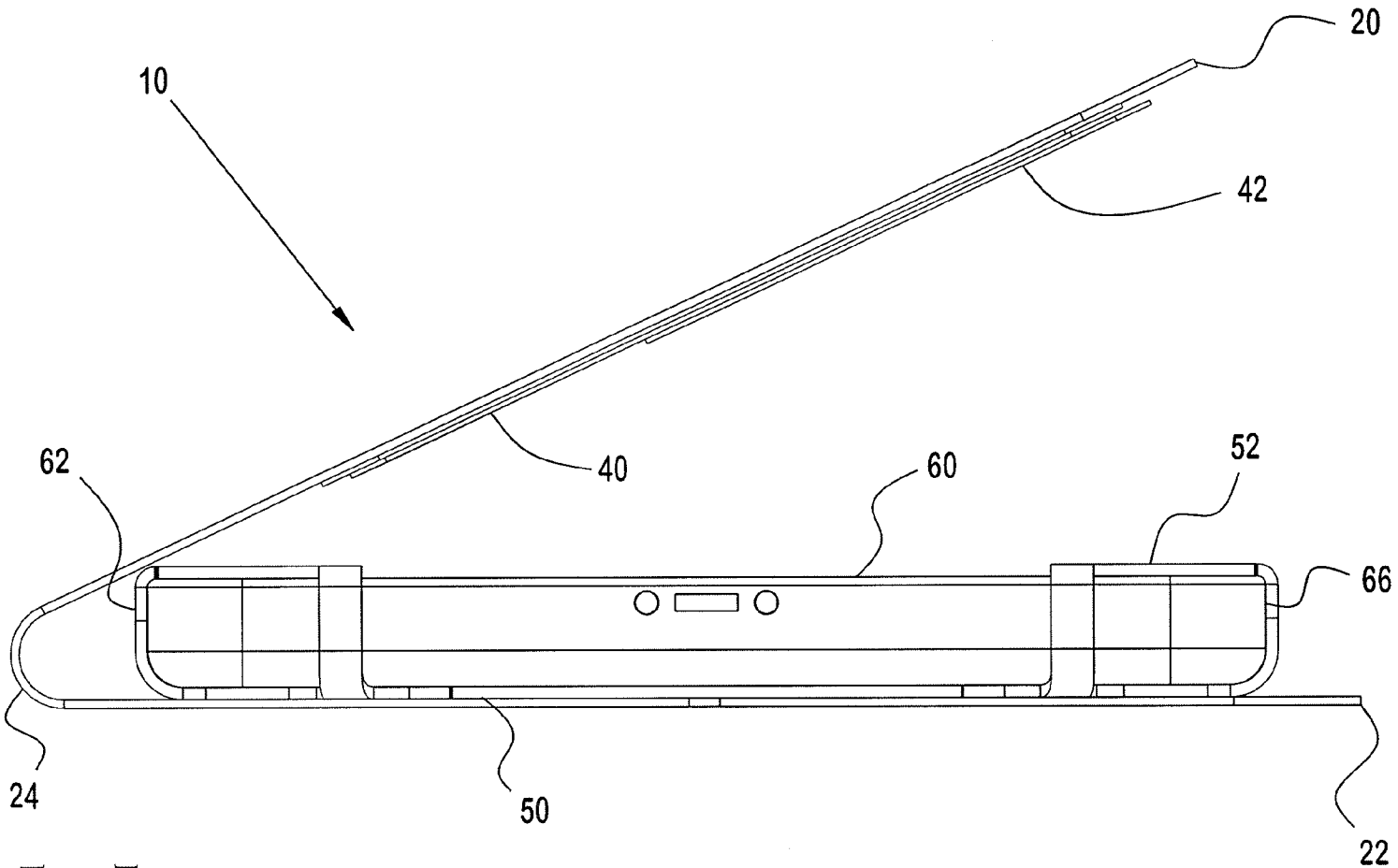
FIG. 7 shows a plan view of the protective cover in an open state.
Figure 8:
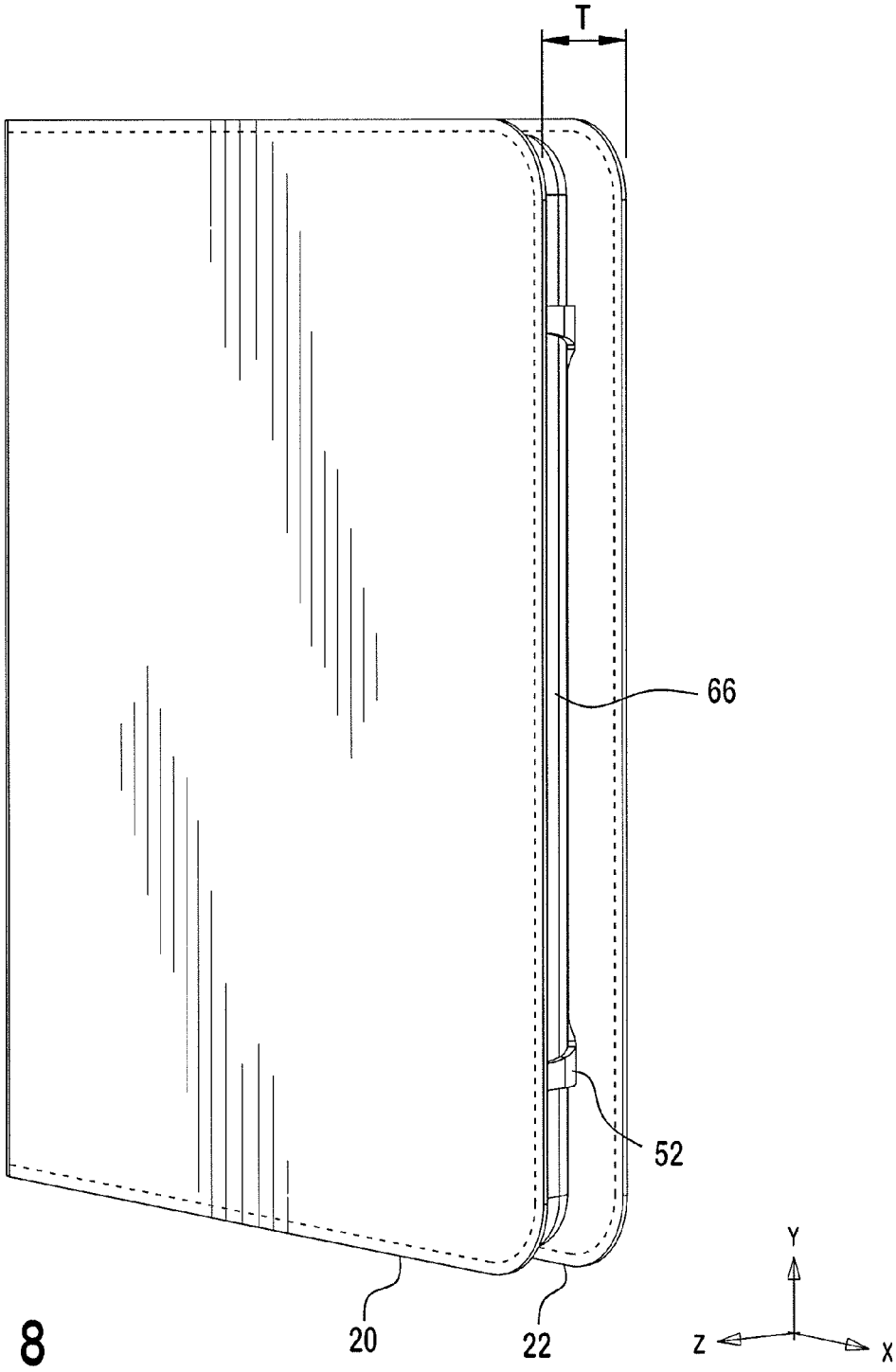
FIG. 8 shows a perspective view of the protective cover including an electronic device in a closed state.

FIG. 7 depicts a side plan view in the y-direction, showing electronic device 60 that is attached to back cover sheet 22 via the holding sheet 50, with holding strips 52. While the articulable back portion 24 wraps around side edge 62 of device 60, side edges of front and rear cover sheets 20, 22 are made to protrude beyond right side edge 66 of device 60 for protection. FIG. 8 shows the protective cover 10 in a closed state, with electronic device 60 being attached to holding sheet 50. The front and rear cover sheets 20, 22 are designed such that they cover electronic device 60 entirely and are therefore higher and wider in x and y-direction as the electronic device 60, to assure protection against side impacts if protective case 10 and device 60 falls to the ground or is otherwise subjected to lateral shocks. Also, holding bands 52 can be located inside a space that is formed by the closed front and rear cover sheets 20, 22, so that holding strips 52 are also protected from wear and tear.

Figure 9:
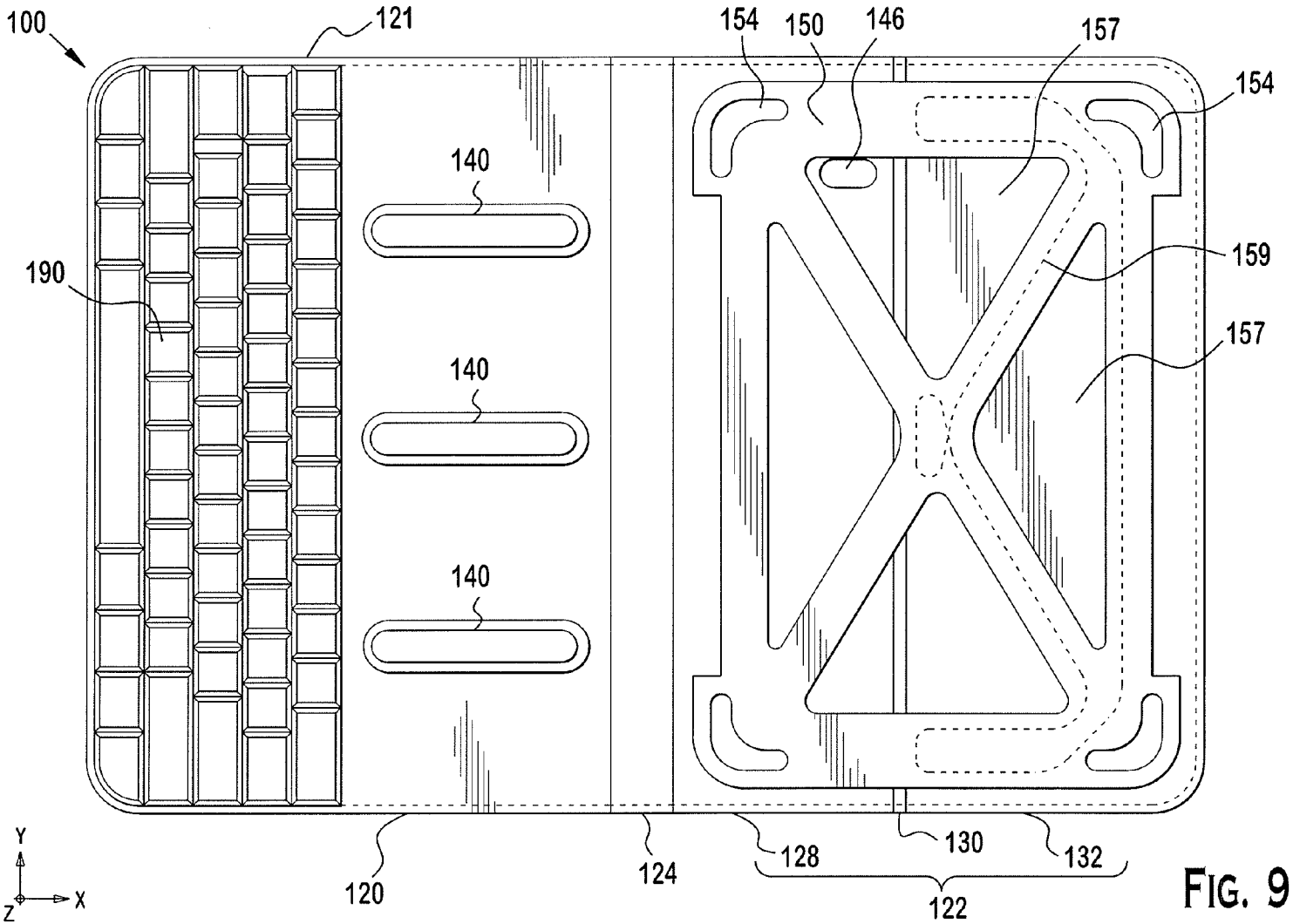
FIG. 9 shows a plan view of another embodiment of the protective cover in an open state without an electronic device.

FIG. 9 shows another embodiment of the protective casing 100, with shorter tabs 140 that are accommodated in the right side of the front cover sheet 120, so that the left side 121 of the cover sheet 120 can accommodate a keyboard 190 for operating an electronic device (not shown). Also, three different tabs 140 are shown, with one arranged substantially in the center as seen from a y-direction. In this embodiment, the range of stand angle $\alpha$ is smaller, since tabs 140 are shorter and are not positioned over keyboard 190, preferably in a range of 60° to 80°. Keyboard 190 can be designed to be very flat in the z-direction so that the protective casing 100 adds none or only slightly more to the thickness T than without a keyboard 190, preferably a foil or membrane keyboard, capacitive button keyboard, or other suitable flat keyboard technology. In addition, left side 121 of cover sheet 120 can also simply be a display surface for displaying a virtual keyboard or a projection keyboard by the electronic device. Preferably, keyboard 190 is configured to communicate wirelessly to electronic device, for example but not limited to a Bluetooth™ or infrared communication interface. Also, in this embodiment, folding member 130 splits rear cover sheet 132 into two sections of different sizes, with middle sheet 128 being smaller than exterior sheet 132.

Moreover, FIG. 9 also shows a variant of flexible and elastic holding sheet 150 having a cross-shaped middle section 159 that is formed by cutting out four triangular cut-out sections 157, to reduce weight and material costs of holding sheet 150. Holding sheet 150 is still formed from a single piece of sheet-like material. Also, cut-out sections 157 can be located at positions in which other electronic elements are located in electronic device, such as but not limited to speakers, microphones, sensors, flashlights, camera lenses, connectors, and a corresponding opening 146 can be provided in back cover sheet 122. Thereby, the other electronic elements will not be obstructed by protective casing 100. Because for fastening an electronic device to holding sheet 150 it is necessary to pull corners of sheet 150 having openings 154 in a direction away from a center of sheet 150, in this embodiment, the cross-shaped middle section 159 is configured to reinforce the sheet 150 and to limit the flexibility and/or elasticity to a desired value.

Figure 10A:
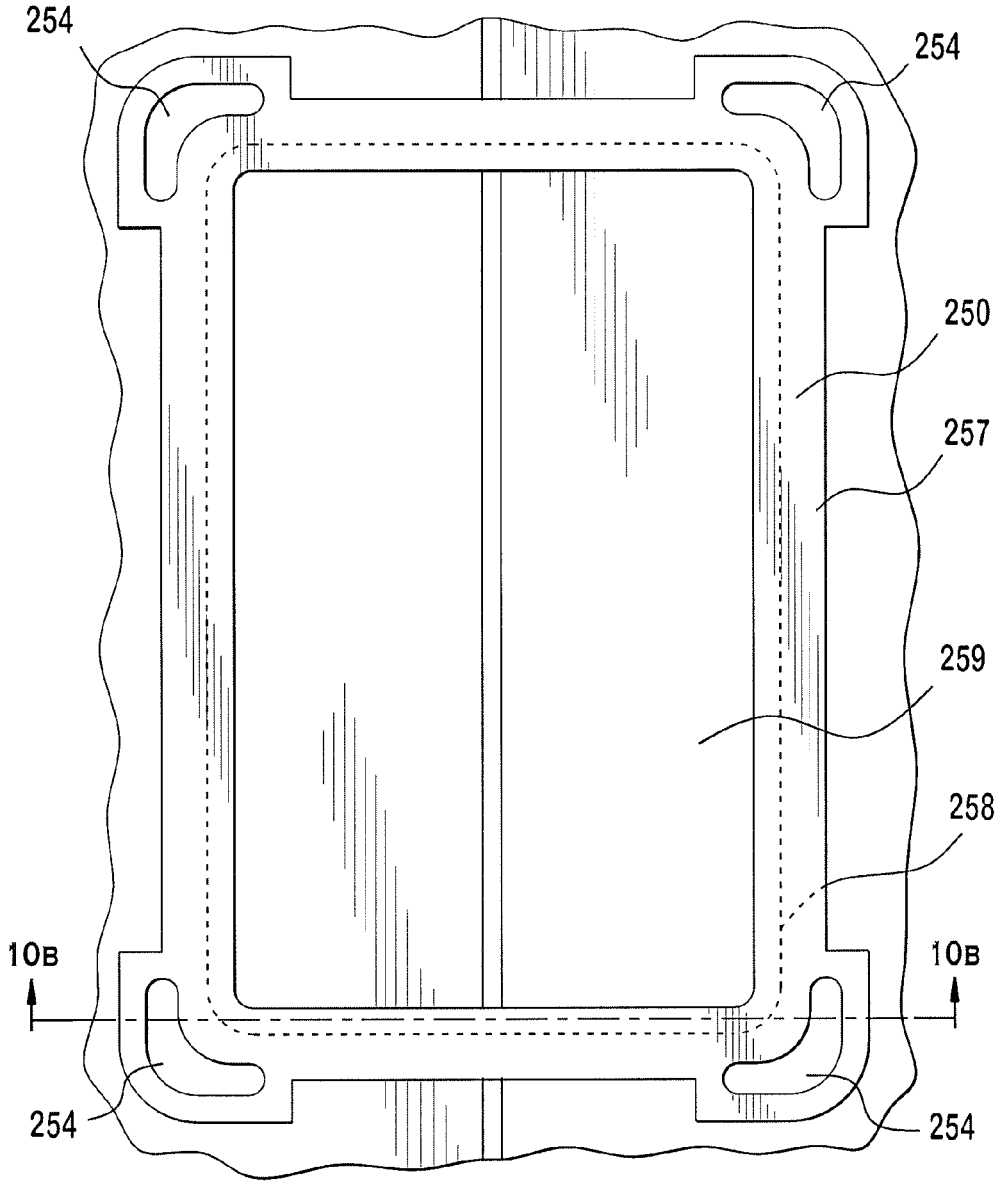
FIG. 10A shows a plan view of another embodiment of the holding sheet for the protective cover.
Figure 10B:
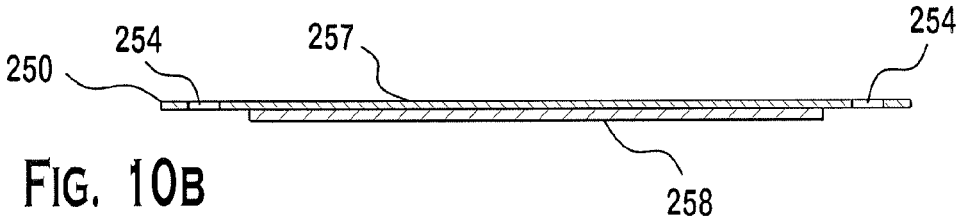
FIG. 10B is a cross-sectional view of the holding sheet along the line A-A indicated in FIG. 10A.

Another embodiment of the holding sheet 250 is shown with respect to FIGS. 10A and 10B, showing a top view of sheet 250, and a cross-sectional view of sheet 250 along lines 10B-10B that is shown in FIG. 10A. Sheet 250 is made of two different layers 257, 258, having a stiff and thin base frame 258, and an elastic sheet 257 out of which attachment openings 254 are cut into. Because sheet 250 is stiffened and reinforced by the presence of base frame 258, the inner section 259 of attachment sheet 250 can be entirely cut out. This embodiment is useful in situations where the back side of electronic device is equipped with electronic elements covering a larger surface, for example larger speakers, etc.

While the invention has been disclosed with reference to certain preferred embodiments, numerous modifications, alterations, and changes to the described embodiments are possible without departing from the sphere and scope of the invention, as defined in the appended claims and their equivalents thereof. Accordingly, it is intended that the invention not be limited to the described embodiments, but that it have the full scope defined by the language of the following claims.

The invention claimed is:

1. A protective cover for an electronic device comprising:

a front cover;

a rear cover including a middle rear cover, an exterior rear cover, and a folding portion that connects the middle rear cover to the exterior rear cover;

an articulable back that connects the rear cover to the front cover;

a holding sheet that forms a plane and is attached to an inner surface of the exterior rear cover and is not attached to the middle rear cover, the holding sheet having openings formed in the plane and located at corners of the holding sheet to form bands, the bands configured to attach to corners of the electronic device for securing the electronic device to the protective cover; and an anti-slip pad attached to an inner surface of the front cover.

2. The protective cover of claim 1, wherein the anti-slip pad has an upper surface having a friction coefficient, the friction coefficient maintaining a position of the electronic device secured by the holding sheet in a configuration where the exterior rear cover is angled from the middle rear cover at the folding portion such that the holding sheet is spaced from the inner surface of the middle rear cover, and an edge of the electronic device is positioned onto the anti-slip pad.

3. The protective cover of claim 1, wherein the anti-slip pad is formed as an elongated pad extending substantially perpendicularly to a longitudinal axis formed by the articulable back.

4. The protective cover of claim 1, wherein the holding sheet is made of a single piece of an elastic mat.

5. The protective cover of claim 4, wherein the holding sheet includes a center portion having no openings.

6. An electronic device casing comprising:

a front cover sheet;

a rear cover sheet including a middle section, an exterior section, and a hinge portion that connects the middle section to the exterior section of the rear cover sheet, the front cover and the rear cover having inner surfaces that face each other when the electronic device casing is in a closed state;

a spine portion that connects the rear cover sheet to the front cover sheet;

an elastic flat holding mat that forms a plane and is attached to an inner surface of the exterior section of the rear cover sheet and is not attached to the middle section of the rear cover sheet, the holding mat having openings formed in the plane and located at corners of the holding mat, the openings configured to pull over corners of the electronic device so that the openings engage with the corners of the electronic device for securing the electronic device to the casing; and an anti-slip pad attached to the inner surface of the front cover sheet.

7. A protective cover for an electronic device comprising:

a front cover;

a rear cover including a middle section, and exterior section, and a hinge portion connecting the middle section to the exterior section of the rear cover;

an articulable back that connects the rear cover to the front cover; and a holding sheet that forms a plane and is attached to an inner surface of the rear cover, such that the holding sheet is attached to the exterior section of the rear cover and is not attached to the middle section of the rear cover, the holding sheet including openings formed in the plane and located at corners of the holding sheet, the openings being configured to form stretchable bands by outer edges of the corners of the holding sheet, the bands configured to attach to corners of the electronic device for securing the electronic device to the protective cover, wherein the holding sheet is made of a single sheet of elastic material.

8. The protective cover according to claim 7, wherein the holding sheet has a thickness in a range of 0.75 mm to 3 mm.

9. The protective cover according to claim 7, wherein the holding sheet is attached to the inner surface of the rear cover by an attachment thread.

10. The protective cover according to claim 7, wherein the holding sheet is configured to lie planarly on the inner surface of the rear cover when the holding sheet is not connected to the electronic device.

11. The protective cover according to claim 7, wherein the holding sheet includes a center portion having no openings, and the corners protruding away from the center portion, each corner having one of said openings.

12. The protective cover according to claim 7, wherein an upper surface of the holding sheet that is configured to be in contact with the electronic device has anti-slip properties.

13. The protective cover according to claim 7, wherein the bands of the holding sheet configured to stretch around the respective corners of the electronic device include a first configuration wherein the electronic device is a first size, and a second configuration wherein the electronic device is a second size, the second size being larger than the first size.

14. The protective cover according to claim 7, wherein the holding sheet is formed of silicone.

15. The protective cover according to claim 7, wherein the holding sheet is formed of rubber.

16. The protective cover according to claim 7, wherein each side edge of the holding sheet extending between respective corners of the holding sheet is recessed such that the corners of the holding sheet which define the openings protrude from the recessed side edges to form protruding portions of the holding sheet, and wherein the protruding portions of the holding sheet are configured to stretch along with the portions of the holding sheet defining an outer perimeter of each opening.

* * * * *